US009464544B2

(12) United States Patent
Hwang et al.

(10) Patent No.: US 9,464,544 B2
(45) Date of Patent: Oct. 11, 2016

(54) VARIABLE VALVE LIFT APPARATUS OF ENGINE

(71) Applicant: MOTONIC CORPORATION, Seoul (KR)

(72) Inventors: Soo Hyun Hwang, Daegu (KR); Jong Wung Park, Daegu (KR); Hye Yoon Choi, Daegu (KR); Do Joong Kim, Ulsan (KR)

(73) Assignee: MOTONIC CORPORATION, Seoul (KR)

( * ) Notice: Subject to any disclaimer, the term of this patent is extended or adjusted under 35 U.S.C. 154(b) by 0 days.

(21) Appl. No.: 14/743,028

(22) Filed: Jun. 18, 2015

(65) Prior Publication Data

US 2015/0369094 A1 Dec. 24, 2015

(30) Foreign Application Priority Data

Jun. 19, 2014 (KR) ..... 10-2014-0075081
Jun. 19, 2014 (KR) ..... 10-2014-0075082

(51) Int. Cl.
*F01L 1/18* (2006.01)
*F01L 13/00* (2006.01)

(52) U.S. Cl.
CPC ..... *F01L 13/0005* (2013.01); *F01L 2013/001* (2013.01)

(58) Field of Classification Search
CPC ..... F01L 13/0005; F01L 2013/001
USPC ..... 123/90.16, 90.39, 90.44
See application file for complete search history.

(56) References Cited

U.S. PATENT DOCUMENTS 8,079,337 B2 * 12/2011 Kim ..... F01L 1/185 123/90.39

FOREIGN PATENT DOCUMENTS

| | | | |
|---|---|---|---|
| JP | 2004-225633 | A | 8/2004 |
| KR | 10-2008-0051513 | A | 6/2008 |
| KR | 10-2010-0064913 | A | 6/2010 |
| KR | 10-1063490 | B1 | 9/2011 |
| KR | 10-1084739 | B1 | 11/2011 |
| KR | 10-1084741 | B1 | 11/2011 |
| KR | 10-2012-0088363 | A | 8/2012 |
| KR | 10-1220346 | B1 | 1/2013 |
| KR | 10-1231383 | B1 | 2/2013 |
| KR | 10-1294044 | B1 | 8/2013 |
| KR | 10-1360048 | B1 | 2/2014 |

* cited by examiner

*Primary Examiner* — Ching Chang
(74) *Attorney, Agent, or Firm* — Novick, Kim & Lee, PLLC; Jae Youn Kim

(57) ABSTRACT

A variable valve lift apparatus of an engine includes a first body rotated at within a preset angle range by rotating a high-speed cam coupled to a camshaft, a second body coupled to the first body or decoupled from the first body and rotated within a preset angle range by rotating a low-cam coupled to the camshaft when the second body is decoupled from the first body, a latching pin provided retractably forward of the first body such that the first body is coupled to or decoupled from the second body, and an actuating unit to retractably actuate the latching pin. The degree of the lift of the valve is variably controlled in two stages of high-speed and low-speed modes through the rotary motion of the high speed cam or low speed cam by coupling or decoupling the first and second bodies to or from each other.

6 Claims, 9 Drawing Sheets

VARIABLE VALVE LIFT APPARATUS OF ENGINE

BACKGROUND OF THE INVENTION

1. Field of the Invention

The present invention relates to a variable valve lift apparatus of an engine, and more particularly to a variable valve lift apparatus of an engine, capable of controlling the degree of lift of a valve according to driving conditions of a vehicle.

2. Description of the Related Art

A valve mechanism applied to a vehicle engine supplies fuel-air mixture to a combustion chamber and discharges combustion gas.

Recently, variable valve mechanisms have been developed to optimize an inflow of the fuel-air mixture and a discharge efficiency of the combustion gas by varying an opening rate or an opening phase of a valve depending on operating areas of an engine which are divided according to operating conditions of the engine, that is, the rotation speed and the load of the engine, and applied to the engine.

Accordingly, the variable valve mechanisms for a vehicle engine can enhance the performance of the engine, such as the fuel efficiency, the torque, or the power of the engine, and reduce an amount of discharged gas.

The variable valve mechanism for the vehicle engine includes a variable valve timing mechanism to vary the opening phase of the valve, a variable valve lift mechanism to vary the opening rate of the valve, and a variable valve operating angle mechanism to vary the operating angle of the valve.

Among them, the variable valve lift mechanism is used to enhance the power and the fuel efficiency of the vehicle at middle and low-speed modes, and classified into rock arm, pivot, tappet, and bucket-type variable valve lift mechanisms.

Applicant of the present invention has multiple disclosures including patent documents (Korean Patent Registration Nos. 10-1084739 and 10-1084741 (issued on Nov. 22, 2011) and Korean Unexamined Patent Publication No. 10-2012-0088363 (filed on Aug. 8, 2012) related to the variable valve lift mechanism.

However, according to the variable valve lift mechanism of the related art, the displacement of an intake valve is always constant regardless of the load of the vehicle, so that an engine speed to represent the optimal efficiency may be restricted.

Accordingly, there is required a technology of deactivating a portion of cylinders at a low-speed and low-load state and activating an entire portion of the cylinders at a high-speed and high-load state to improve the efficiency of the engine.

Meanwhile, conventionally, although hydraulic pressure is used to deactivate a valve or control the valve in two stages, the structure of the variable valve lift mechanism becomes complicated, so that the workability may be degraded.

In addition, when the hydraulic pressure is used, the viscosity of hydraulic oil reacts sensitively to the temperature, so that the hydraulic pressure may be changed. Accordingly, the variable valve lift mechanism erroneously operates so that the precision may be degraded when adjusting the degree of the lift of the valve.

SUMMARY OF THE INVENTION

An object of the present invention is to provide a variable valve lift apparatus of an engine, capable of controlling the degree of lift of a valve according to driving conditions of a vehicle.

Another object of the present invention is to provide a variable valve lift apparatus of an engine, capable of deactivating a portion of cylinders at a low-speed and low-load state of the vehicle.

In order to accomplish the above objects, there is provided a variable valve lift apparatus of an engine, includes a first body rotated at an angle within a preset angle range by rotating a high-speed cam coupled to a camshaft, a second body coupled to the first body or decoupled from the first body to maintain a valve in a opening state or a closing state, a latching pin provided retractably forward of the first body such that the first body is coupled to or decoupled from the second body, and an actuating unit to retractably actuate the latching pin, to perform a deactivation control operation of the valve to deactivate a cylinder by operating the latching pin such that the first body is decoupled from the second body in a low-speed and low-load state of the engine.

In addition, there is provided a variable valve lift apparatus of an engine, including a first body rotated at an angle within a preset angle range by rotating a high-speed cam coupled to a camshaft, a second body coupled to the first body or decoupled from the first body and rotated at an angle within a preset angle range by rotating a low-cam coupled to the camshaft when the second body is decoupled from the first body, a latching pin provided retractably forward of the first body such that the first body is coupled to or decoupled from the second body, and an actuating unit to retractably operate the latching pin, to perform a variable two-stage control operation at a high-speed mode and a low-speed mode based on an operating condition of the engine.

As described above, according to the variable valve lift apparatus of the engine of the present invention, the deactivation control operation of the valve to deactivate a portion of the cylinders and the variable two-stage control operation at the high-speed mode and low-speed mode can be performed according to the operating conditions of the engine.

In other words, according to the present invention, the first and second bodies are coupled to or decoupled from each other using the latching pin to perform the opening and closing operation and the deactivation control operation for the valve, so that a portion of the cylinders can be deactivated in the low-speed and low-load state of the engine.

Therefore, according to the present invention, the fuel consumption can be minimized in the low-speed and low-load state of the engine to improve the efficiency of the engine and maximize the fuel efficiency of the vehicle.

In addition, according to the present invention, the first and second bodies are coupled to each other or decoupled from each other using the latching pin, so that the degree of the lift of the valve can be controlled in the two stages of the high-speed and low-speed modes through the rotary motion of the high-seed cam or the low-speed cam.

Further, according to the present invention, as the deactivation control operation and the variable two-stage control operation of the valve are mechanically performed, the influence by the temperature can be prevented, and the degree of the lift of the valve can be precisely controlled.

DETAILED DESCRIPTION OF THE INVENTION

Hereinafter, a variable valve lift apparatus of an engine according to an exemplary embodiment of the present invention will be described with reference to accompanying drawings.

The variable valve lift apparatus of the engine according to the present invention is configured to perform a deactivation control operation of activating or deactivating a cylinder according to driving conditions of a vehicle and a variable two-stage control operation of controlling the degree of lift of a valve in two stages of high and low speeds.

Hereinafter, according to the present invention, the constitution of realizing the deactivation control operation of the valve will be described in a first embodiment, and the constitution of realizing the variable two-stage control operation of variably controlling the valve in two stages will be described in a second embodiment based on the constitution of the first embodiment.

To this end, it is noted that one cam may be mounted on a camshaft of the engine in the case that the deactivation control operation is realized, and a high-speed cam and low-speed cams provided at both sides of the high-speed cam may be mounted on the camshaft of the engine in the case that the variable two-stage control operation is realized.

[First Embodiment]

Figure 1:
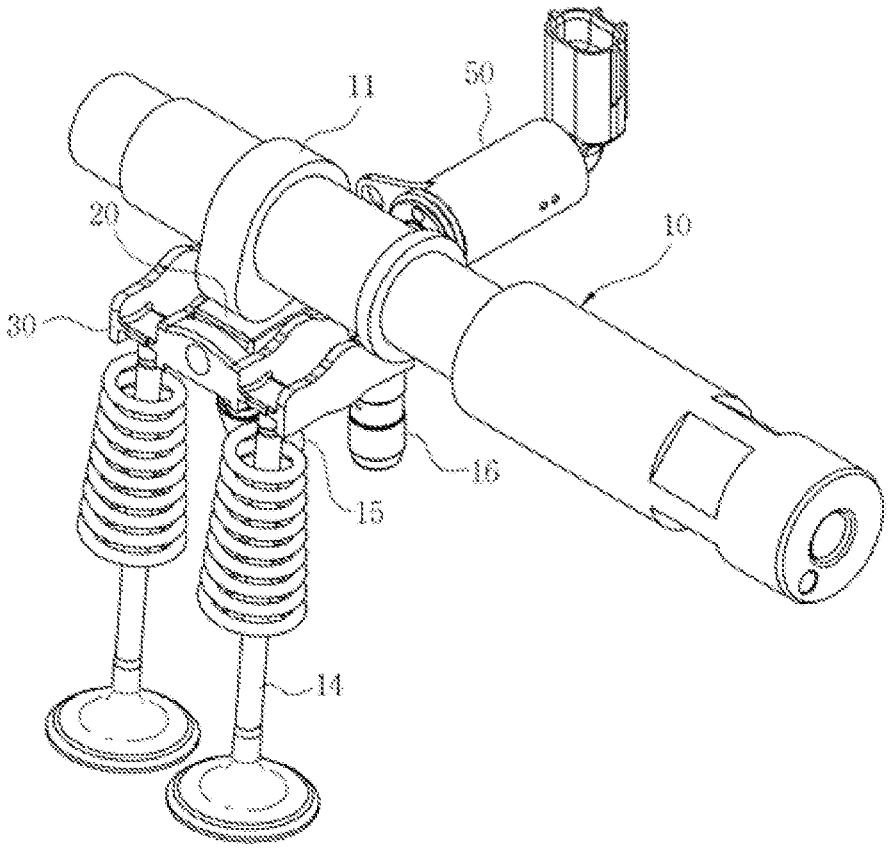
FIG. 1 is a perspective view showing a variable valve lift apparatus of an engine according to an exemplary embodiment of the present invention.
Figure 2:
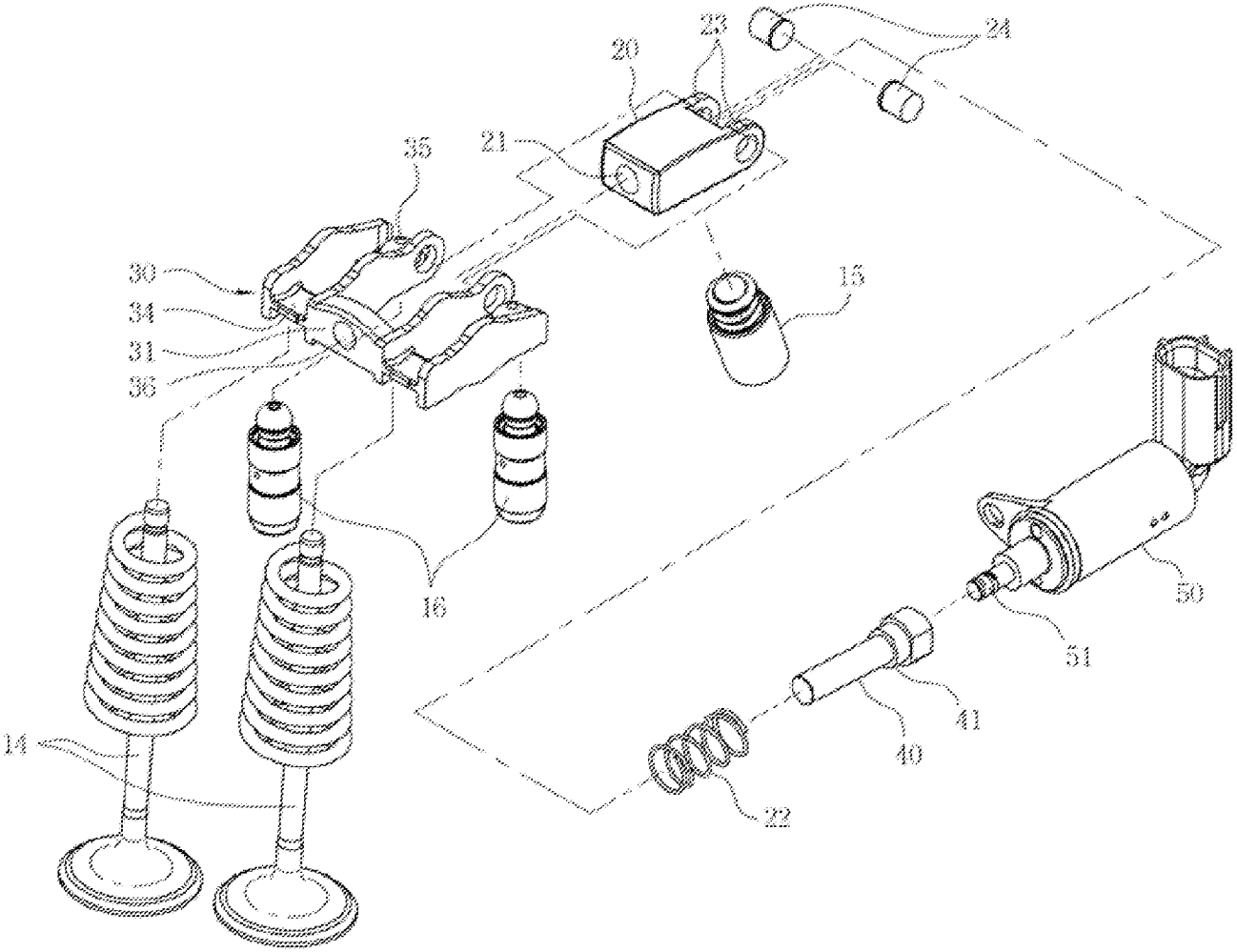
FIG. 2 is an exploded perspective view showing the variable valve lift apparatus of the engine shown in FIG. 1.

FIG. 1 is a perspective view showing the variable valve lift apparatus of an engine according to an exemplary embodiment of the present invention, and FIG. 2 is an exploded perspective view showing the variable valve lift apparatus of the engine shown in FIG. 1.

In drawings, reference signs 'F', 'B', 'U', 'D', 'L', and 'R' represent "forward", "backward", "upward" "downward", "left side", and "right side", respectively.

As shown in FIGS. 1 and 2, the variable valve lift apparatus of the engine according to the first embodiment of the present invention includes a first body 20 rotated at an angle within a preset angle range by rotating a cam coupled to a camshaft, a second body 30 to maintain a valve 14 in a opening state or closing state based on the coupling state of the first body 20, a latching pin 40 provided retractably forward of the first body 20 so that the first body 20 is coupled to or decoupled from the second body 30, and an actuating unit 50 to retractably actuate the latching pin 40.

In addition, the variable valve lift apparatus of the engine according to the exemplary embodiment of the present invention may further include a return spring 15 mounted under the first body 20 to provide restoring force for the first body 20 so that the first body 20 rotated by the first cam 11 returns to an original position thereof.

The first body 20 may be formed in a substantially rectangular parallelepiped shape, and may be formed therein with a coupling space 21 to which the latching pin 40 is coupled.

A latching spring 22 may be mounted in the coupling space 21 formed in the first body 20 to provide restoring force for the latching pin 40.

The latching spring 22 may be manufactured with an inner diameter corresponding to an outer diameter of the latching pin 40.

The first body 20 may be formed on both rear ends thereof with a pair of flange parts 23, and the flange parts 23 may be formed therein with coupling holes to which coupling pins 24 are coupled, respectively.

The coupling pins 24 may be through-coupled to the coupling holes formed in the flange parts 23 of the first body 20 and coupling holes formed in inner sidewalls 32 of the second body 30 to be described later.

Accordingly, the first body 20 may be hinge-rotated about the coupling pins 24.

The second body 30 may include a front wall 31 and both sidewalls which are formed in a U shape when viewed from the top, so that the front wall 31 and the sidewalls of the second body 30 are arranged on a front surface and both lateral sides of the first body 20, respectively.

Each sidewall of the second body 30 may include an inner sidewall 32 and an outer sidewall 33.

A pressing plate 34 may be mounted at each of both sides of the front wall 31 and interposed between the inner sidewall 32 and the outer sidewall 33 to press an upper end of the valve 14.

The pressing plates 34 may be mounted horizontally in a longitudinal direction of the second body 20, and press the upper end of the valve 14 when the second body 20 is rotated to move up or down the upper end of the valve 14, thereby opening or closing the valve 14.

A rear end portion of the second body 30 may be supported by a pivot support member 16.

According to the present embodiment, the pivot support member 16 may include a hydraulic lash adjuster to automatically adjust an opening of the valve 14 using hydraulic pressure.

For example, the hydraulic lash adjuster extends or contracts depending on the variation in the pressure of oil in the state that the hydraulic lash adjuster continuously is supplied with oil therein, thereby finely adjusting the opening of the valve 14.

In other words, if the pressure of the oil is lower than preset pressure, the hydraulic lash adjuster is maintained in a contacting state as a check valve provided in the hydraulic lash adjuster is maintained in a closing state.

On the contrary, if the pressure of the oil is equal to or more than the preset pressure, as the check valve is opened to open the moving path of the oil, the hydraulic lash adjuster extends to move up the rear end of the second body 30, so that the opening of the valve 14 can be adjusted.

To this end, a support plate 35 may be formed between rear end portions of the inner sidewall 32 and the outer sidewall 33 of the second body 30 so that the support plate 35 may be supported by an upper end of the pivot support member 16 in contact with the upper end of the pivot support member 16.

Accordingly, the second body 30 may be rotated about the pivot support member 16.

In addition, the second body 30 may be formed in the front wall 31 thereof with an insertion hole 36 into which the latching pin 40 is inserted when the latching pin 40 is moved forward.

The latching pin 40 may be formed in the shape of a cylinder having a substantially circularly-shaped or ovally-shaped sectional surface. In the state that the latching pin 40 is coupled to the coupling space 21 of the first body 20, the latching pin 40 may move forward of the first body 20 as the actuating unit 50 extends.

In addition, the latching pin 40 may be formed on an outer circumference thereof with an annular step 41 to support a rear end portion of the latching spring 22 so that the latching pin 40 is moved backward by the elasticity of the latching spring 22.

The actuating unit 50 may be provided in the form of a solenoid to move forward and backward a solenoid pin 51 according to a control signal from an electronic control unit (not shown) to control the operation of the engine.

For example, if the control signal is applied to the solenoid in the state that a front end portion of the solenoid pin 51 be in contact with a rear end portion of the latching pin 40, the solenoid generates a magnetic filed from an internal winding coil to move forward the solenoid pin 51 and to press the latching pin 40 so that the latching pin 40 is moved.

Figure 3:
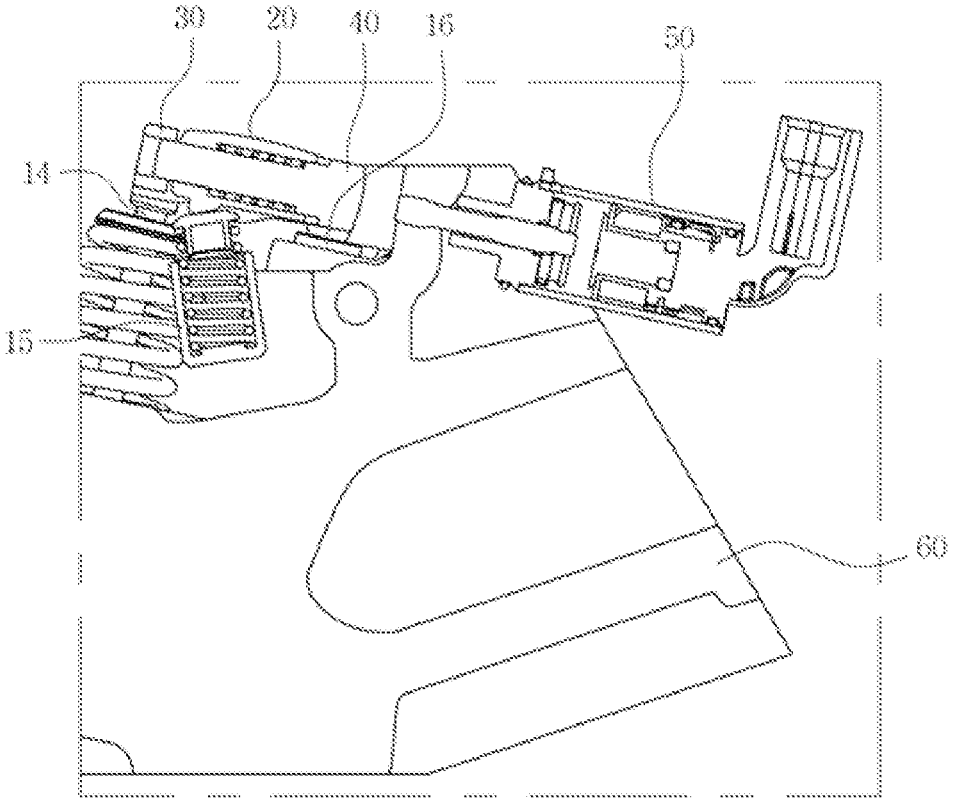
FIG. 3 is a perspective view showing a carrier in which the variable valve lift apparatus of the engine shown in FIG. 1 is installed.

FIG. 3 is a perspective view showing a carrier in which the variable valve lift apparatus of the engine shown in FIG. 1 is installed.

As shown in FIG. 3, variable valve lift apparatuses of the engine may be provided in number corresponding to that of cylinders, and installed to be inclined at a preset angle with respect to the upper portion of a carrier 60.

Hereinafter, the operating method of the variable valve lift apparatus of the engine according to the first embodiment of the present invention will be described in detail with reference to FIGS. 4 and 5.

Figure 4:
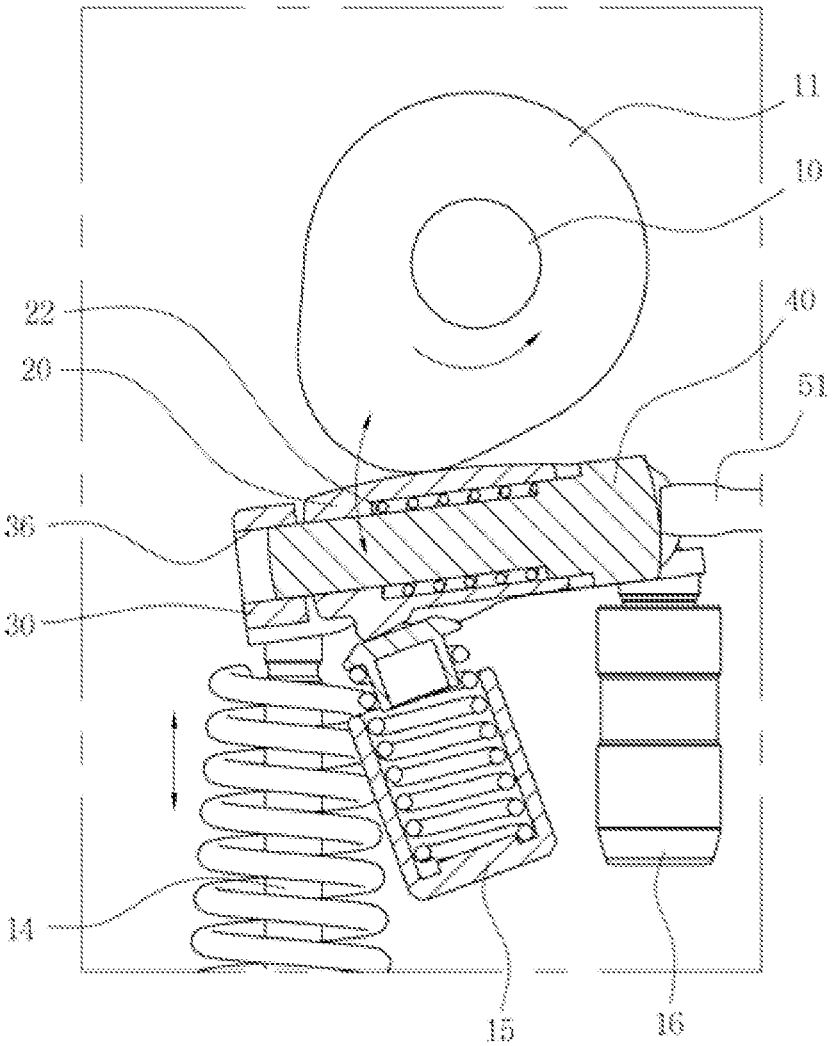
FIGS. 4 and 5 are views showing the operating state of a variable valve lift apparatus of an engine according to the first embodiment of the present invention.
Figure 5:
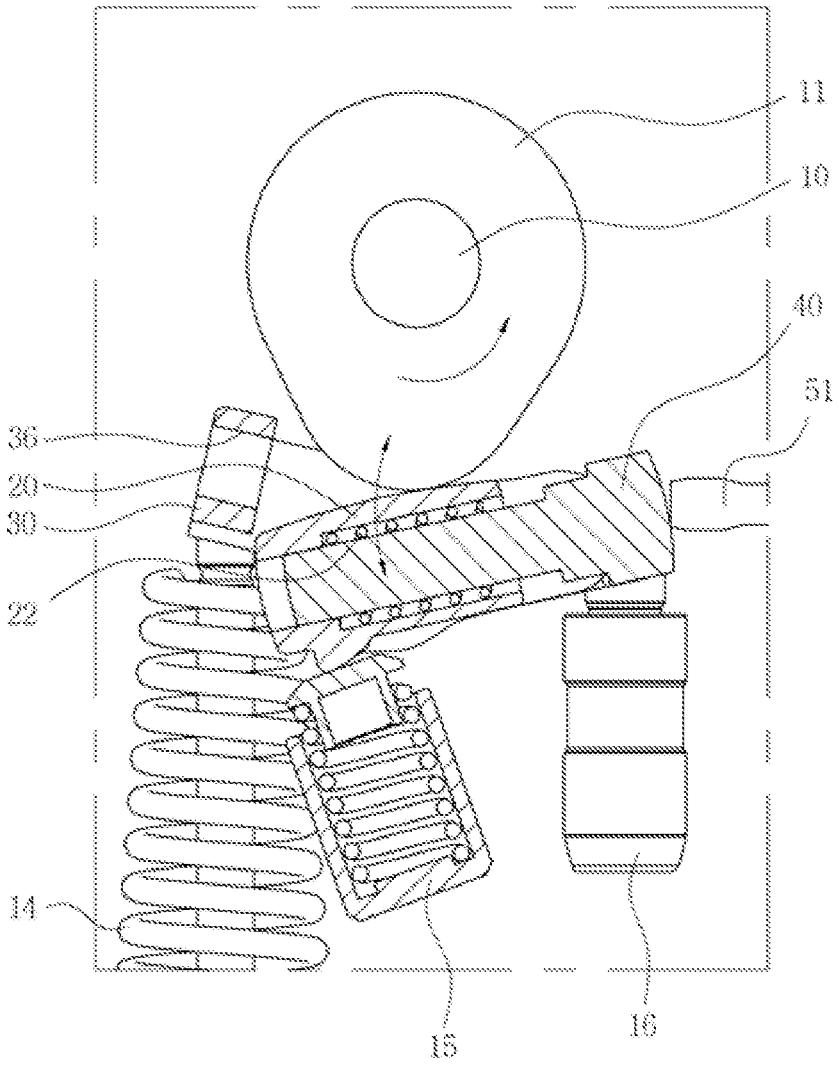

FIGS. 4 and 5 are views showing the operating state of the variable valve lift apparatus of the engine according to the first embodiment of the present invention.

FIG. 4 is a view showing the operation state of opening or closing the valve through the rotory motion of the cam in the variable valve lift apparatus of the engine.

In addition, FIG. 4 shows the operating state of controlling the deactivation of the valve.

The variable valve lift apparatus of the engine according to the first embodiment of the present invention operates the actuating unit 50 to move forward the latching pin 40 as shown in FIG. 4 when opening or closing the valve 14 through the rotary motion of the cam 11.

Then, the front end portion of the latching pin 40 is moved forward of the first body 20 and inserted into the insertion hole 36 of the second body 30, so that the first body 20 is coupled to the second body 30.

Accordingly, the variable valve lift apparatus of the engine according to the first embodiment of the present invention may open or close the valve 14 by moving up or down the valve 14 as the first and second bodies 20 and 30 are rotated at an angle within a preset angle range through the rotary motion of the cam 11.

On the contrary, in the variable valve lift apparatus according to the first embodiment of the present invention, the power applied to the actuating unit 50 is shout off by the control signal of the electronic control unit in the case that the deactivation control operation of the valve 14 is realized to deactivate a portion of the cylinders.

Accordingly, the latching pin 40 is moved backward by the elasticity of the latching spring 22 as shown in FIG. 5.

In this case, as the latching pin 40 is moved backward to be received in the first body 20, the first body 20 is decoupled from the second body 30.

Then, the front and rear end portions of the second body 30 are fixed in contact with the upper end portions of the valve 14 and the pivot support member 16, respectively.

Therefore, in the variable valve lift apparatus of the engine according to the first embodiment of the present invention, even if the cam 11 is rotated, since the second body 30 is fixed in contact with the upper end of the valve 14, the deactivation control operation of the valve 14 can be realized.

As described above, according to the present invention, the opening or closing operation of the valve and the deactivation control operation can be realized by selectively coupling or decoupling the first body to or from the second body using the latching pin, so that a portion of the cylinders can be deactivated in the low-speed and low-load state of the engine.

Therefore, according to the present invention, the fuel consumption can be minimized in the low-speed and low-load state to improve the efficiency of the engine and maximize the fuel efficiency of the vehicle.

[Second Embodiment]

Hereinafter, the structure of a variable valve lift apparatus of an engine according to the second embodiment of the present invention will be described in detail with reference to FIGS. 6 and 7.

Figure 6:
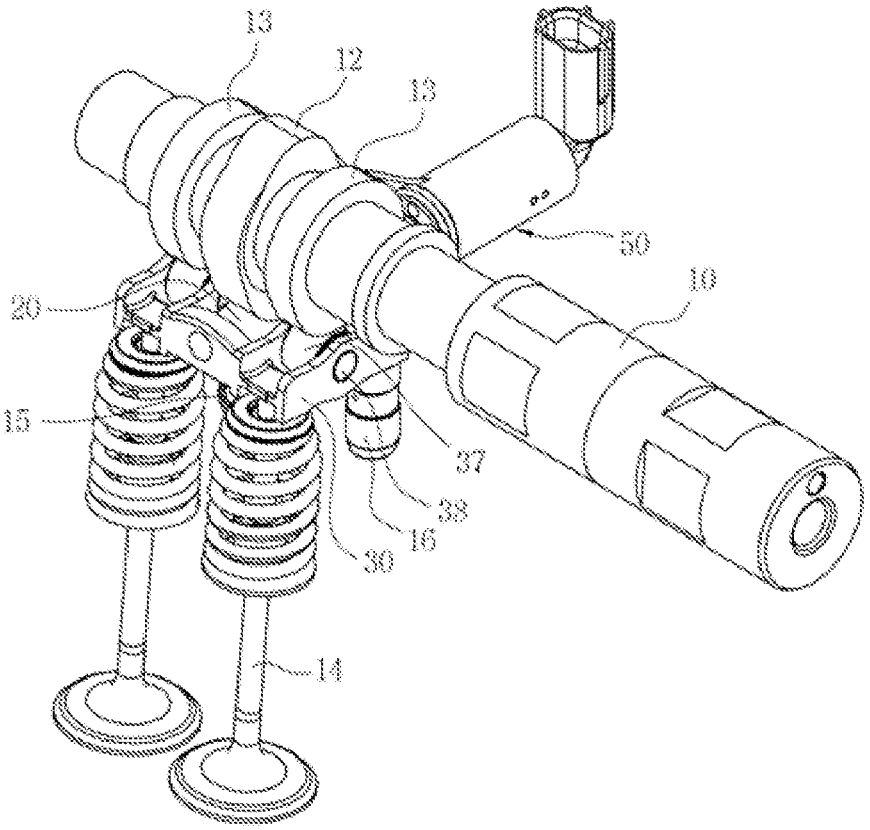
FIG. 6 is a perspective view showing a variable valve lift apparatus of an engine according to the second embodiment of the present invention.

FIG. 6 is a perspective view showing the variable valve lift apparatus of the engine according to the second embodiment of the present invention. FIG. 7 is an exploded perspective view showing the variable valve lift apparatus of the engine shown in FIG. 6.

Figure 7:
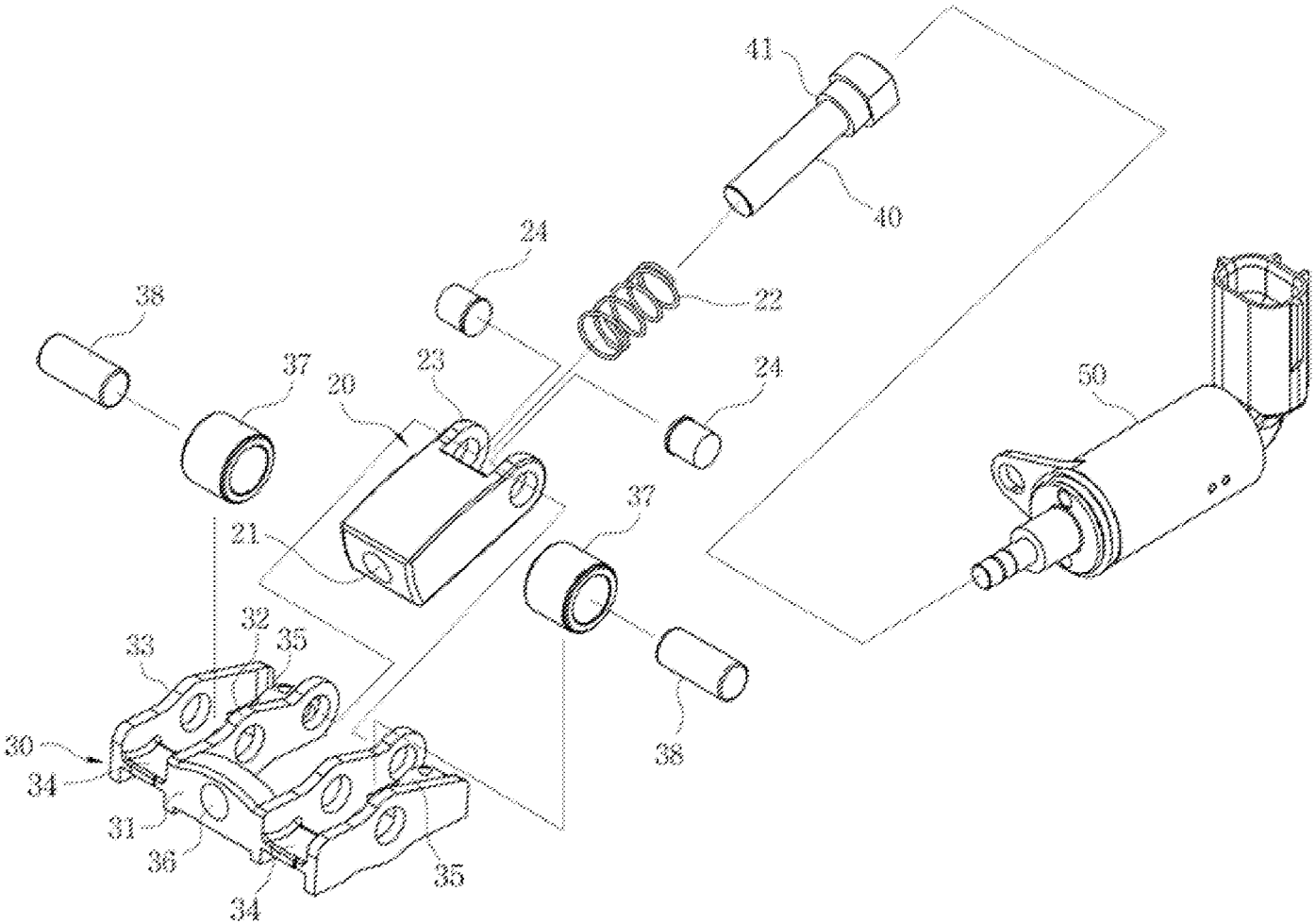
FIG. 7 is an exploded perspective view showing the variable valve lift apparatus of the engine shown in FIG. 6.

The variable valve lift apparatus of the engine according to the second embodiment of the present invention has the structure similar to that of the first embodiment as shown in FIGS. 6 and 7 except that additional components may be further provided to perform the variable two-stage control operation for the degree of the lift of the valve according to the operating conditions of the engine at a high-speed or low-speed mode.

In other words, a high-speed cam 12, which is used to control the degree of the lift of the valve 14 to a maximum value at a high-speed and high-load state of the engine, and a low-speed cam 13, which is used to control the degree of the lift of the valve 14 at the low-speed and low-load state of the engine, may be mounted on the cam shaft 10.

The high-speed cam 12 may be manufactured in a shape corresponding to that of the cam 11 according to the first embodiment.

A pair of low-speed cams 13 may be provided so that the low-speed cams 13 make contact with both sides of the second body 30, and may be mounted at both sides of the second body 30.

Each low-speed cam 13 has the maximum diameter less than that of the high-speed cam 12.

A pair of rollers 37 may be mounted at both sides of the second body 30 to make contact with the low-speed cams 13, respectively, to perform rotary motion at the low-speed and low-load state of the engine.

The rollers 37 may be rotatably mounted on fixing pins 38 through-coupled to the inner sidewalls 32 and the outer sidewalls 33 at both sides of the second body 30, respectively.

Hereinafter, the operating method of the variable valve lift apparatus of the engine according to the second embodiment of the present invention will be described in detail with reference to FIGS. 8 and 9.

Figure 8:
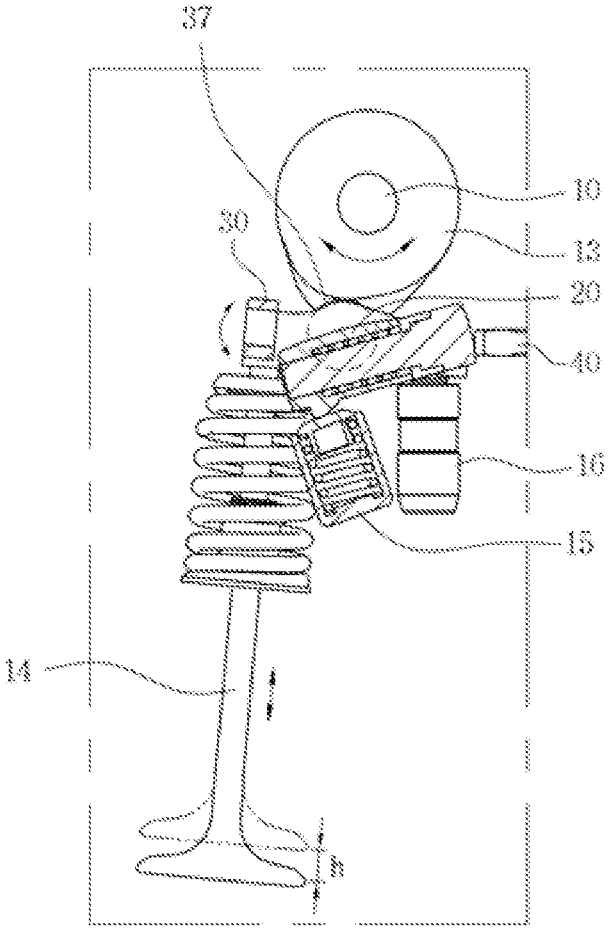
FIGS. 8 and 9 are views showing the operating state of the variable valve lift apparatus of the engine according to the second embodiment of the present invention.
Figure 9:
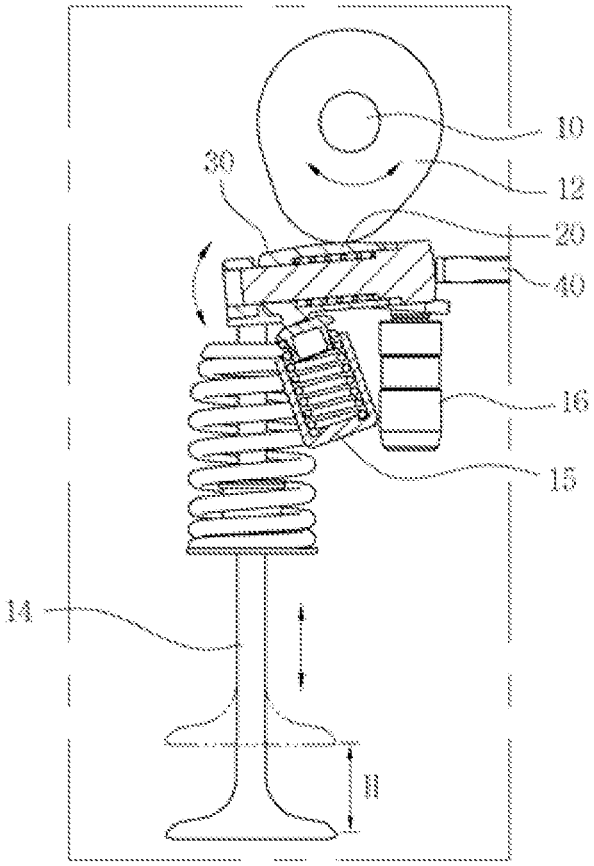

FIGS. 8 and 9 show the operating state of the variable valve lift apparatus of the engine according to the second embodiment of the present invention.

FIG. 8 shows the operating state of the variable valve lift apparatus of the engine, which operates at the low-speed mode when the engine is in the low-speed and low-load state.

FIG. 9 shows the operating state of the variable valve lift apparatus of the engine, which operates at the high-speed mode when the engine is in the high-speed and high-load state The variable valve lift apparatus of the engine according to the second embodiment of the present invention operates in the state that the latching pin 40 is held received in the first body 20 so that the first and second bodies 20 and 30 are decoupled from each other as shown in FIG. 8 when the engine is in the low-speed and low-load state.

In this case, the roller 37 mounted in the second body 30 makes contact with the low-speed cam 13 mounted on the camshaft 10 to perform rotary motion.

Then, the second body 30 is hinge-rotated about the pivot support member 16 through the rotary motion of the low-speed cam 13 to open or close the valve 14.

Meanwhile, the variable valve lift apparatus of the engine according to the second embodiment of the present invention operates the actuating unit 50 to move forward the latching pin 40 as shown in FIG. 9 when the engine is in the high-speed and high-load state of the engine.

Then, the front end portion of the latching pin 40 protrudes forward of the first body 20 so that the latching pin 40 is inserted into the insertion hole 36 of the second body 30 to couple the first body 20 to the second body 30.

In this case, the first body 20 makes contact with the high-speed cam 12 mounted on the camshaft 10 to perform rotary motion.

Therefore, the variable valve lift apparatus of the engine according to the second embodiment of the present invention rotates the first and second bodies 20 and 30 at an angle within a present angle range through the rotary motion of the high-speed cam 12 while moving up or down the valve 14 to open or close the valve 14.

In this case, as the degree of the lift of the valve 14 by the high-speed cam 12 becomes greater than that of the valve 14 by the low-speed cam 13, the flux of air supplied to the cylinder of the engine is increased.

As described above, according to the present invention, the first and second bodies are coupled to or decoupled from each other using the latching pin so that the degree of the lift of the valve can be controlled in two stages of high-speed and low-speed modes through the rotary motion of the high-speed cam and the low-speed cam.

According to the present invention, through the above procedure, the deactivation control operation of the valve to deactivate a portion of the cylinders and the variable two-stage control operation at the high-speed mode and low-speed mode can be performed according to the operating conditions of the engine.

The present invention is applied to a variable valve lift apparatus technology of an engine to perform the deactivation control operation of the valve to deactivate a portion of the cylinders and the variable two-stage control operation at the high-speed mode and low-speed mode.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A variable valve lift apparatus of an engine, comprising:

a first body rotated at an angle within a preset angle range by rotating a high-speed cam coupled to a camshaft;

a second body coupled to the first body or decoupled from the first body and rotated at an angle within a preset angle range by rotating a low-speed cam coupled to the camshaft when the second body is decoupled from the first body;

a latching pin provided retractably forward of the first body such that the first body is coupled to or decoupled from the second body; and an actuating unit to retractably actuate the latching pin, wherein a pair of flanges parts are formed at rear portions of both sides of the first body, a coupling pin is coupled to each flange part such that the first body is rotatably coupled to the second body, and the second body comprises: a front wall, inner sidewalls, and outer sidewalls installed at a front surface and both sides of the second body, respectively, to be arranged on a front surface and both lateral sides of the first body; a pressing plate mounted at each of both sides of the front wall to press an upper end of a valve by rotating the second body; a support plate interposed between rear end portions of the inner sidewall and the outer sidewall of the second body and supported by an upper end of a pivot support member in contact with the upper end of the pivot support member, and a roller interposed between the inner sidewall and the outer sidewall to make contact with the low-speed cam such that the roller is rotated, to perform a deactivation control operation of the valve to deactivate a cylinder by operating the latching pin such that the first body is decoupled from the second body in a low-speed and low-load state of the engine.

2. The variable valve lift apparatus of claim 1, wherein the first body is formed therein with a coupling space to which the latching pin is retractably coupled, and a latching spring is mounted in the coupling space to provide restoring force for the latching pin.

3. The variable valve lift apparatus of claim 1, wherein the front wall is formed therein with an insertion hole into which a front end portion of the latching pin is inserted when the latching pin protrudes forward.

4. A variable valve lift apparatus of an engine, comprising:

a first body rotated at an angle within a preset angle range by rotating a high-speed cam coupled to a camshaft;

a second body coupled to the first body or decoupled from the first body and rotated at an angle within a preset angle range by rotating a low-speed cam coupled to the camshaft when the second body is decoupled from the first body;

a latching pin provided retractably forward of the first body such that the first body is coupled to or decoupled from the second body; and an actuating unit to retractably operate the latching pin, wherein a pair of flanges parts are formed at rear portions of both sides of the first body, a coupling pin is coupled to each flange part such that the first body is rotatably coupled to the second body, and the second body comprises: a front wall, inner sidewalls, and outer sidewalls installed at a front surface and both sides of the second body, respectively, to be arranged on a front surface and both lateral sides of the first body; a pressing plate mounted at each of both sides of the front wall to press an upper end of a valve by rotating the second body; a support plate interposed between rear end portions of the inner sidewall and the outer sidewall of the second body and supported by an upper end of a pivot support member in contact with the upper end of the pivot support member, and a roller interposed between the inner sidewall and the outer sidewall to make contact with the low-speed cam such that the roller is rotated, to perform a variable two-stage control operation at a high-speed mode and a low-speed mode based on an operating condition of the engine.

5. The variable valve lift apparatus of claim 4, wherein the first body is formed therein with a coupling space to which the latching pin is retractably coupled, and a latching spring is mounted in the coupling space to provide restoring force for the latching pin.

6. The variable valve lift apparatus of claim 4, wherein the front wall is formed therein with an insertion hole into which a front end portion of the latching pin is inserted when the latching pin protrudes forward.

* * * * *